US011708977B2

(12) United States Patent
Kim

(10) Patent No.: US 11,708,977 B2
(45) Date of Patent: Jul. 25, 2023

(54) OVEN APPLIANCE WITH TURNTABLE

(71) Applicant: Haier US Appliance Solutions, Inc., Wilmington, DE (US)

(72) Inventor: Seog-Tae Kim, Prospect, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 73 days.

(21) Appl. No.: 17/197,370

(22) Filed: Mar. 10, 2021

(65) Prior Publication Data

US 2022/0290870 A1 Sep. 15, 2022

(51) Int. Cl.

| | |
|---|---|
| ***F24C 15/16*** | (2006.01) |
| ***F24C 3/12*** | (2006.01) |
| ***F24C 7/08*** | (2006.01) |

(52) U.S. Cl.

CPC ..... *F24C 15/16* (2013.01); *F24C 3/128* (2013.01); *F24C 7/085* (2013.01)

(58) Field of Classification Search

CPC ..... F24C 15/16; F24C 7/085; F24C 3/128

See application file for complete search history.

(56) References Cited

U.S. PATENT DOCUMENTS

| | | | | | |
|---|---|---|---|---|---|
| 3,131,685 | A * | 5/1964 | Bergfield | ..... | A47J 37/0745 126/25 AA |
| 5,667,714 | A | 9/1997 | Cho | | |
| 5,787,873 | A * | 8/1998 | Whitehouse | ..... | A47J 37/0745 126/25 AA |
| 8,267,257 | B2 | 9/2012 | Doyal | | |
| 2010/0276414 | A1 * | 11/2010 | Nam | ..... | F24C 15/16 219/392 |
| 2019/0110630 | A1 | 4/2019 | Beil | | |

FOREIGN PATENT DOCUMENTS

| | | | | | |
|---|---|---|---|---|---|
| EP | 1767860 | B1 | 9/2011 | | |
| GB | 2271045 | A * | 3/1994 | ..... | H05B 6/6411 |
| JP | H09119651 | A | 5/1997 | | |
| JP | H11173563 | A | 6/1999 | | |

* cited by examiner

*Primary Examiner* — Thien S Tran
(74) *Attorney, Agent, or Firm* — Dority & Manning, P.A.

(57) ABSTRACT

An oven appliance includes a cabinet that defines a vertical direction. A chamber is defined within the cabinet for receipt of food items for cooking. A rack is slidably received within the chamber above a bottom wall of the chamber along the vertical direction. A turntable is rotatably mounted on the rack. The oven appliance also includes a telescopic shaft positioned and configured to extend and retract along the vertical direction between an engaged position wherein the shaft engages the turntable to rotate the turntable and a disengaged position wherein the shaft is spaced apart from the turntable along the vertical direction.

12 Claims, 13 Drawing Sheets

OVEN APPLIANCE WITH TURNTABLE

FIELD OF THE INVENTION

The subject matter of the present disclosure relates generally to an oven appliance, such as a full-size oven appliance or range appliance, including a turntable which is selectively rotatable within a cooking chamber or cavity of the oven.

BACKGROUND OF THE INVENTION

Oven appliances generally include a cabinet that defines a cooking chamber for cooking food items therein, such as by baking or broiling the food items. To heat the cooking chamber for cooking, oven appliances include one or more heating elements positioned at a top portion, a bottom portion, or both the top portion and the bottom portion of the cooking chamber. Some oven appliances also include a convection heating element and fan for convection cooking cycles. The heating element or elements may be used for various cycles of the oven appliance, such as a preheat cycle, a cooking cycle, or a self-cleaning cycle.

In order to promote even heating of items, e.g., food, within the cooking chamber, smaller cooking appliances such as microwave oven appliances sometimes include a rotating turntable in the cooking chamber which is mounted on the floor of the cooking chamber with wheels in order to permit rotation of the turntable within the cooking chamber. However, conventional oven appliances, e.g., wall ovens, ranges, etc., that employ lower heating elements such as electric resistance heating elements or a bottom gas burner do not include turntables because the floor of the cooking chamber is to close to the lower heating element for a turntable to be placed there.

Accordingly, an oven appliance that includes both a lower heating element and a turntable would be desirable.

BRIEF DESCRIPTION OF THE INVENTION

Aspects and advantages of the invention will be set forth in part in the following description, may be apparent from the description, or may be learned through practice of the invention.

In one exemplary embodiment, an oven appliance is provided. The oven appliance includes a cabinet defining a vertical direction, a lateral direction, and a transverse direction. The vertical, lateral, and transverse directions are mutually perpendicular. The cabinet includes a front portion spaced apart from a back portion along the transverse direction and a left side spaced apart from a right side along the lateral direction. A chamber is defined within the cabinet for receipt of food items for cooking. The chamber is delineated by a plurality of walls including a bottom wall, a left side wall, and a right side wall. A rack is slidably received on embossed ribs formed on the left side wall and the right side wall such that the rack is positioned within the chamber and above the bottom wall of the chamber along the vertical direction. A turntable is rotatably mounted on the rack. The oven appliance also includes a telescopic shaft positioned and configured to extend and retract along the vertical direction between an engaged position wherein the shaft engages the turntable to rotate the turntable and a disengaged position wherein the shaft is spaced apart from the turntable along the vertical direction.

In another exemplary embodiment, an oven appliance is provided. The oven appliance includes a cabinet. The cabinet defines a vertical direction. A chamber is defined within the cabinet for receipt of food items for cooking. A rack is slidably received within the chamber above a bottom wall of the chamber along the vertical direction. A turntable is rotatably mounted on the rack. The oven appliance also includes a telescopic shaft positioned and configured to extend and retract along the vertical direction between an engaged position wherein the shaft engages the turntable to rotate the turntable and a disengaged position wherein the shaft is spaced apart from the turntable along the vertical direction.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
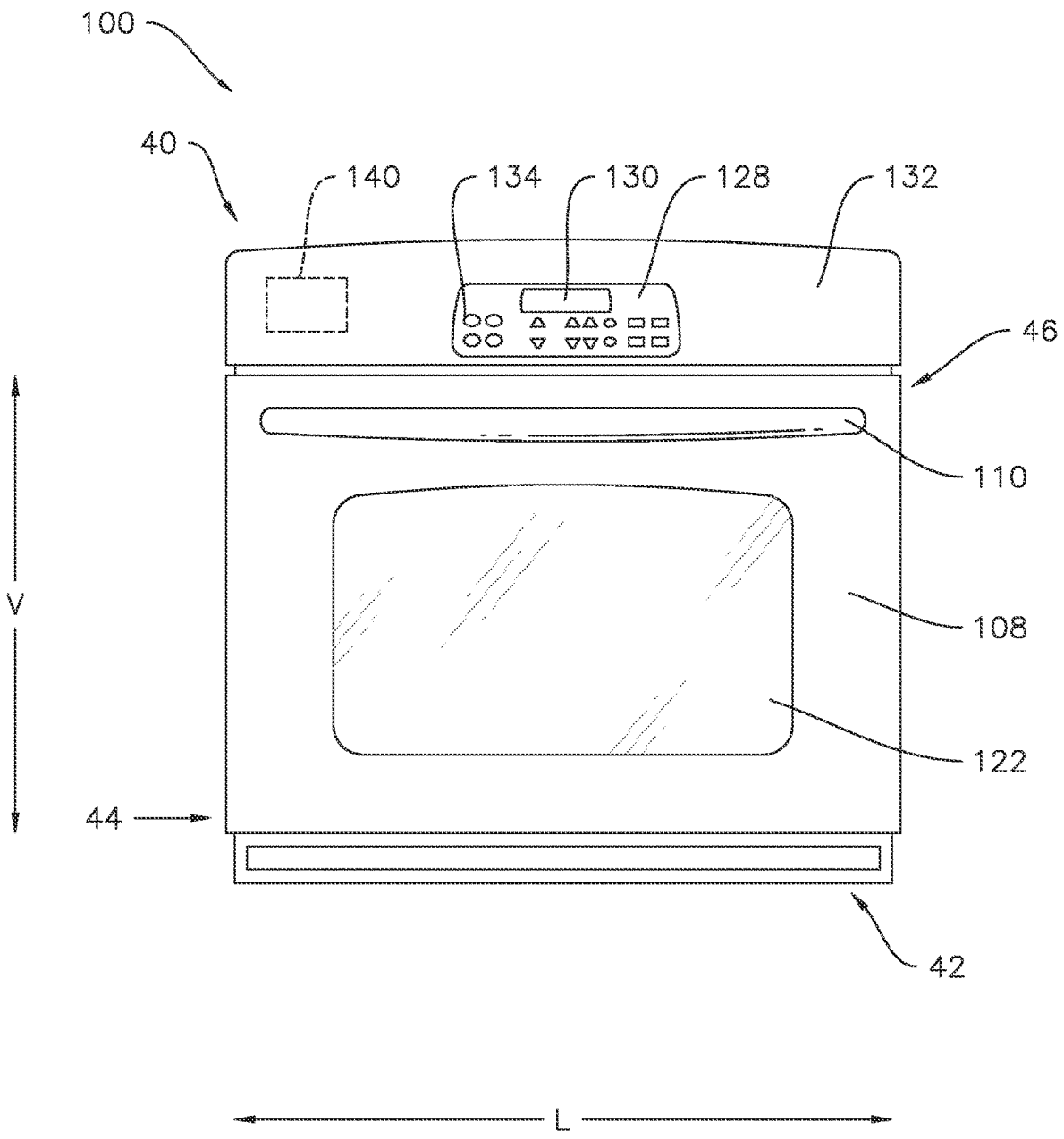
FIG. 1 provides a front view of an exemplary oven appliance according to one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. In the context of an angle or direction, such terms include values within ten degrees of the stated direction. For example, "generally vertical" includes directions within ten degrees of vertical in any direction, e.g., clockwise or counter-clockwise.

Figure 2:
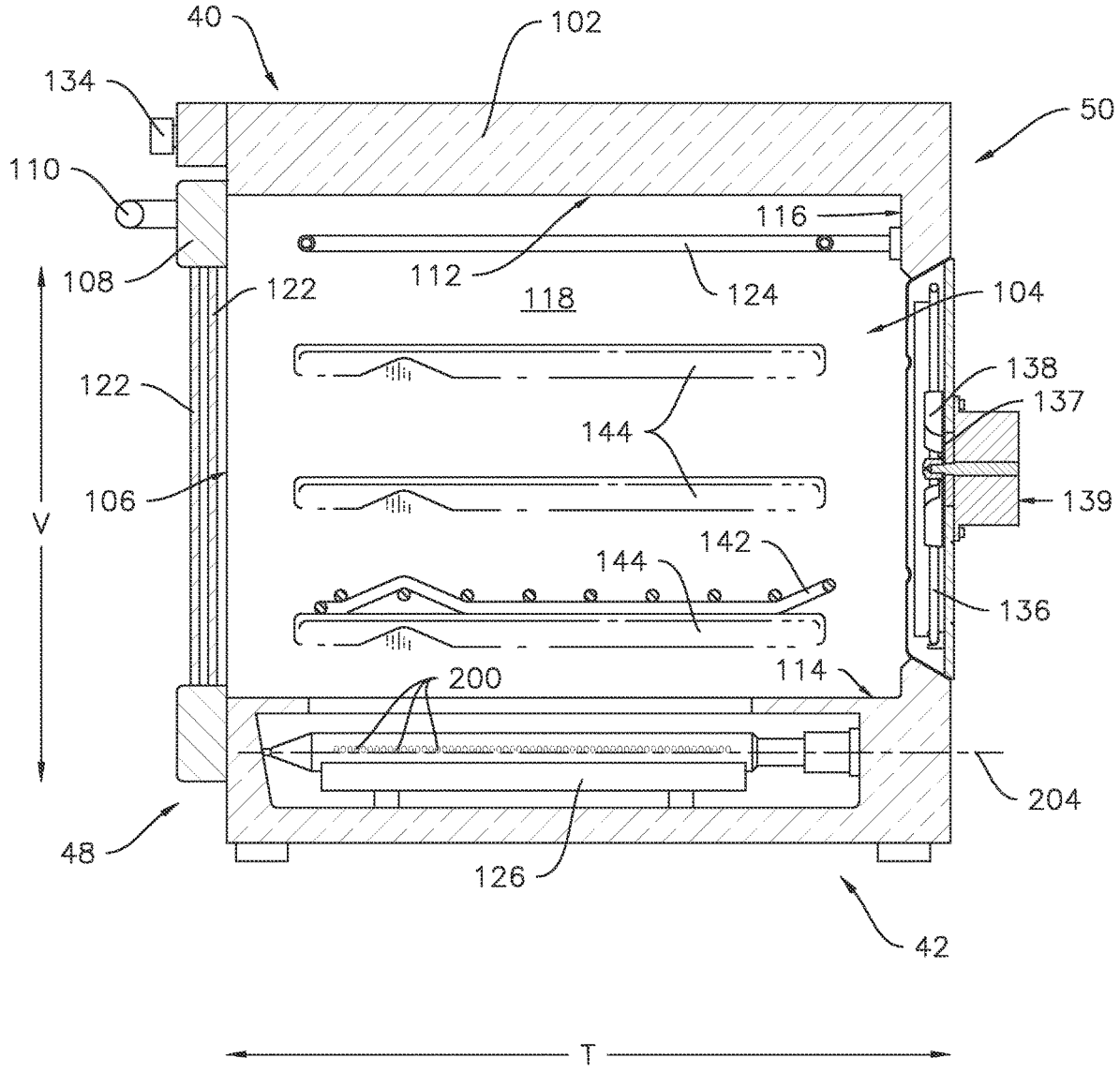
FIG. 2 provides a side section view of the oven appliance of FIG. 1.

FIGS. 1 and 2 illustrate an oven appliance 100 according to an exemplary embodiment of the present subject matter. Oven appliance 100 includes an insulated cabinet 102 which defines a vertical direction V, a lateral direction L, and a transverse direction T. The vertical, lateral, and transverse directions V, L, and T are mutually perpendicular and form an orthogonal direction system. Cabinet 102 extends between a top portion 40 and a bottom portion 42 along the vertical direction V. Cabinet 102 extends between a left side 44 and a right side 46 along the lateral direction L and between a front portion 48 and a back portion 50 along the transverse direction T.

Still referring to FIGS. 1 and 2, for this exemplary embodiment, oven appliance 100 includes an insulated cabinet 102 with an interior cooking chamber 104 defined by a top wall 112, a floor or bottom wall 114, a back wall 116, and a pair of opposing side walls 118. Cooking chamber 104 is configured for the receipt of one or more food items to be cooked. Oven appliance 100 includes a door 108 pivotally mounted to cabinet 102 at the opening 106 of cabinet 102 to permit selective access to cooking chamber 104 through opening 106. A handle 110 is mounted to door 108 and assists a user with opening and closing door 108. For example, a user can pull on handle 110 to open or close door 108 and access cooking chamber 104.

Oven appliance 100 can include a seal (not shown) between door 108 and cabinet 102 that assists with maintaining heat and cooking vapors within cooking chamber 104 when door 108 is closed as shown in FIGS. 1 and 2. Multiple parallel glass panes 122 provide for viewing the contents of cooking chamber 104 when door 108 is closed and assist with insulating cooking chamber 104. A baking rack 142 is positioned in cooking chamber 104 for the receipt of food items or utensils containing food items. Baking rack 142 is slidably received onto embossed ribs or sliding rails 144 such that rack 142 may be conveniently moved into and out of cooking chamber 104 when door 108 is open.

One or more heating elements may be included at the top, bottom, or both of cooking chamber 104 to provide heat to cooking chamber 104 for cooking. Such heating element(s) can be gas, electric, microwave, or a combination thereof. For example, in the embodiment shown in FIG. 2, oven appliance 100 includes a top heating element 124 which, in the illustrated example embodiment is an electric resistance heating element 124, and a bake heating element or bottom heating element 126, which, in the illustrated example embodiment of FIG. 2 is a gas burner 126, and bottom heating element 126 is positioned adjacent to and below bottom wall 114.

In the illustrated example embodiment, oven appliance 100 also has a convection heating element 136 and convection fan 138 positioned adjacent back wall 116 of cooking chamber 104. Convection fan 138 is powered by a convection fan motor 139. Further, convection fan 138 can be a variable speed fan—meaning the speed of fan 138 may be controlled or set anywhere between and including, e.g., zero and one hundred percent (0%-100%). In certain embodiments, oven appliance 100 may also include a bidirectional triode thyristor (not shown), i.e., a triode for alternating current (TRIAC), to regulate the operation of convection fan 138 such that the speed of fan 138 may be adjusted during operation of oven appliance 100. The speed of convection fan 138 can be determined by controller 140. In addition, a sensor 137 such as, e.g., a rotary encoder, a Hall effect sensor, or the like, may be included at the base of fan 138, for example, between fan 138 and motor 139 as shown in the exemplary embodiment of FIG. 2, to sense the speed of fan 138. The speed of fan 138 may be measured in, e.g., revolutions per minute ("RPM"). In some embodiments, the convection fan 138 may be configured to rotate in two directions, e.g., a first direction of rotation and a second direction of rotation opposing the first direction of rotation. For example, in some embodiments, reversing the direction of rotation, e.g., from the first direction to the second direction or vice versa, may still direct air from the back of the cavity. As another example, in some embodiments reversing the direction results in air being directed from the top and/or sides of the cavity rather than the back of the cavity. Additionally, the convection heating features are optional and are shown and described herein solely by way of example. In additional embodiments, the oven appliance 100 may include different convection heating features or may not include convection heating features at all.

In various embodiments, more than one convection heater, e.g., more than one convection heating elements 136 and/or convection fans 138, may be provided. In such embodiments, the number of convection fans and convection heaters may be the same or may differ, e.g., more than one convection heating element 136 may be associated with a single convection fan 138. Similarly, more than one top heating element 124 and/or more than one bottom heating element 126 may be provided in various combinations, e.g., one top heating element 124 with two or more bottom heating elements 126, two or more bottom heating elements 126 with no top heating element 124, etc.

Oven appliance 100 includes a user interface 128 having a display 130 positioned on an interface panel 132 and having a variety of controls 134. Interface 128 allows the user to select various options for the operation of oven 100 including, e.g., various cooking and cleaning cycles. Operation of oven appliance 100 can be regulated by a controller 140 that is operatively coupled to, i.e., in communication with, user interface 128, heating elements 124, 126, and other components of oven 100 as will be further described.

For example, in response to user manipulation of the user interface 128, controller 140 can operate the heating element(s). Controller 140 can receive measurements from one or more temperature sensors (not shown) which are in or in thermal communication with the cooking chamber 104. Controller 140 may also provide information such as a status indicator, e.g., a temperature indication, to the user with display 130. Controller 140 can also be provided with other features as will be further described herein.

Controller 140 may include a memory and one or more processing devices such as microprocessors, CPUs, or the like, such as general or special purpose microprocessors operable to execute programming instructions or micro-control code associated with operation of oven appliance 100. The memory may represent random access memory such as DRAM or read only memory such as ROM or FLASH. In one embodiment, the processor executes programming instructions stored in memory. The memory may be a separate component from the processor or may be included onboard within the processor. The memory can store information accessible by the processor(s), including instructions that can be executed by processor(s). For example, the instructions can be software or any set of instructions that when executed by the processor(s), cause the processor(s) to perform operations. For the embodiment depicted, the instructions may include a software package configured to operate the system, e.g., to execute exemplary methods of operating the oven appliance 100. Controller 140 may also be or include the capabilities of either a proportional (P), proportional-integral (PI), or proportional-integral-derivative (PID) control for feedback-based control implemented with, e.g., temperature feedback from one or more sensors such as temperature sensors and/or probes, etc.

Controller 140 may be positioned in a variety of locations throughout oven appliance 100. In the illustrated embodiment, controller 140 is located next to user interface 128 within interface panel 132. In other embodiments, controller 140 may be located under or next to the user interface 128, otherwise within interface panel 132, or at any other appropriate location with respect to oven appliance 100. Generally, controller 140 will be positioned within the cabinet 102. In the embodiment illustrated in FIG. 1, input/output ("I/O") signals are routed between controller 140 and various operational components of oven appliance 100 such as heating elements 124, 126, 136, convection fan 138, controls 134, display 130, alarms, and/or other components as may be provided. In one embodiment, user interface 128 may represent a general purpose I/O ("GPIO") device or functional block.

Although shown with touch type controls 134 in FIG. 1, it should be understood that controls 134 and the configuration of oven appliance 100 shown in FIG. 1 is provided by way of example only. More specifically, user interface 128 may include various input components, such as one or more of a variety of electrical, mechanical, or electro-mechanical input devices including rotary dials, push buttons, and touch pads, e.g., such as a knob as illustrated in FIG. 2, among other possible examples and combinations. User interface 128 may include other display components, such as a digital or analog display device designed to provide operational feedback to a user. User interface 128 may be in communication with controller 140 via one or more signal lines or shared communication busses.

While oven 100 is shown as a wall oven, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the controls 134, as mentioned above, are possible. As another example, the oven appliance 100 may include multiple doors 108 instead of or in addition to the single door 108 illustrated. Such examples include a dual cavity oven, a French door oven, and others. As still another example, one or more of the illustrated heating elements may be substituted with microwave heating elements, or any other suitable heating elements. The examples described herein are provided by way of illustration only and without limitation.

Referring specifically to FIG. 2, it may be seen that the gas burner (which is an embodiment of a lower or bottom heating element 126) defines a generally cylindrical shape with a longitudinal axis 204 extending therethrough. The gas burner 126 also includes a plurality of ports 200 defined therein, e.g., in one or more linear arrays on one or more sides of the gas burner 126. As will be recognized and understood by those of ordinary skill in the art, the ports 200 orient and direct combustion products, e.g., flames and heated gases, from the gas burner 126, e.g., to or towards the cooking chamber 104. In the example embodiment illustrated in FIG. 2, the gas burner 126 is oriented generally along the transverse direction T, e.g., the longitudinal axis 204 of the gas burner 126 is parallel to or within ten degrees of the transverse direction T. In additional embodiments, the lower heating element may be any suitable heating element, such as any one of various types of radiant heating elements, e.g., an electric resistance heating element, such as in the example embodiment illustrated in FIG. 3.

Figure 3:
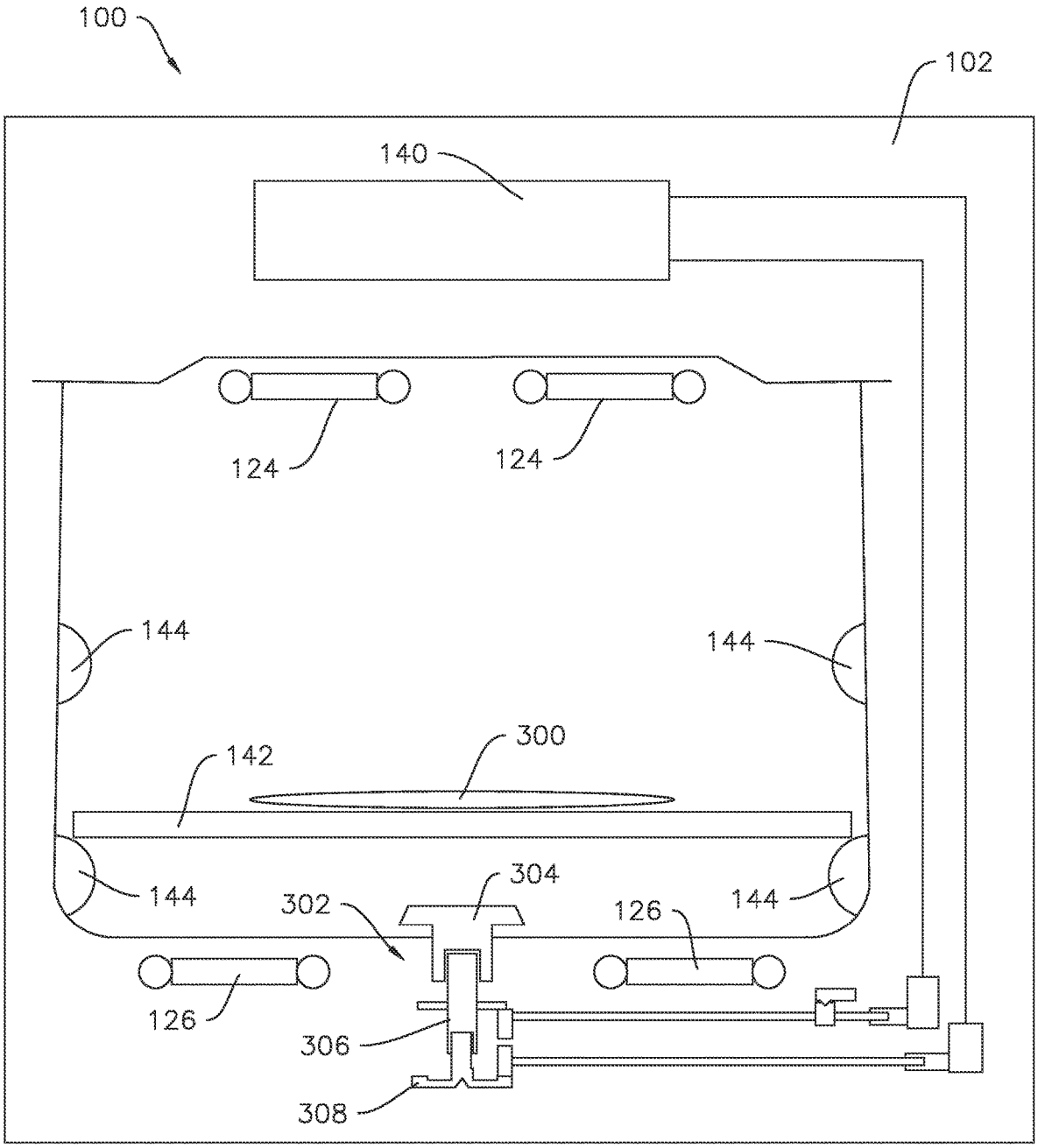
FIG. 3 provides a schematic front section view of the oven appliance of FIG. 1.

In some embodiments, e.g., as illustrated in FIG. 3, the oven appliance 100 may include a turntable 300 rotatably mounted on the rack 142. Also, the bottom heating elements 126 in the example embodiment illustrated in FIG. 3 include electric heating elements, similar to the top heating element 124 described above. Also as may be seen in FIG. 3, the controller 140 may be in operative communication with a pair of motors (the motors will be described in more detail below) in order to selectively engage or disengage a telescopic shaft 302 with or from the turntable 300 and to rotate the turntable 300 on the rack 142 when the shaft 302 is engaged with the turntable 300.

Figure 4:
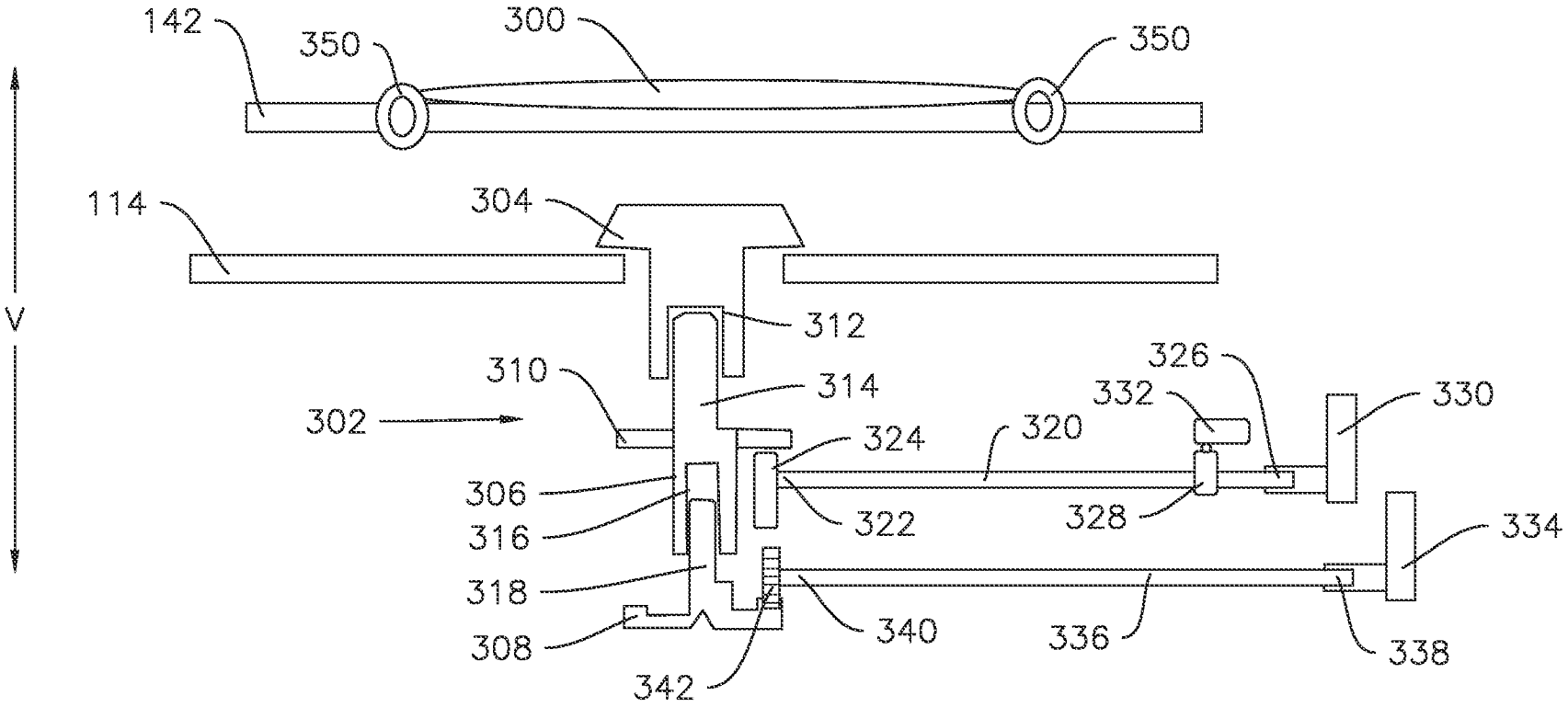
FIG. 4 provides an enlarged schematic section view of a turntable system according to one or more embodiments of the present subject matter which may be incorporated into an oven appliance such as the oven appliance of FIG. 1.

Turning now to FIG. 4, the oven appliance 100 may include a telescopic shaft 302 which is operatively coupled to an elevating motor 330 and a rotating motor 334. Accordingly, the telescopic shaft 302 may be positioned and configured to extend and retract along the vertical direction V between an engaged position wherein the shaft 302 engages the turntable 300 and a disengaged position wherein the shaft 302 is spaced apart from the turntable 300 along the vertical direction V. The shaft 302, and in particular an uppermost key portion 304 thereof, may extend through the bottom wall 114 of the cooking chamber 104, whereby the drive system (e.g., motors 330 and 334 and adjoining components) which extends, retracts, and rotates the shaft 302 is disposed within the cabinet 102 and outside of the cooking chamber 104, such as below the bottom wall 114 of the cooking chamber 104 and next to or between the bottom heating element(s) 126.

When the shaft 302 and the turntable 300 are engaged, e.g., when the shaft 302 is in the engaged position, the shaft 302 may, in some embodiments, be configured to rotate the turntable 300, e.g., the shaft 302 may transfer rotational movement from the rotating motor 334 to the turntable 300. For example, the oven appliance 100 may include a rotating bar 336 which extends along a direction perpendicular to the vertical direction V from a first end 338 to a second end 340. The rotating bar 336 may also define a longitudinal axis, e.g., between the first end 338 of the rotating bar 336 and the second end 340 of the rotating bar 336. The rotating bar 336 may be coupled to the rotating motor 334 at the first end 338 of the rotating bar 336, whereby the rotating motor 334 may impart rotational movement to the rotating bar 336, such as rotating the bar 336 about the longitudinal axis of the rotating bar 336. Such rotational movement may include up to full and continuous rotation through one or more complete revolutions in one or more directions, including rotation in multiple directions, oscillation, or other desirable extents and/or directions of rotation. A rotating gear 342 may be positioned at the second end 340 of the rotating bar 336. The rotating gear 342 may be engaged with a base gear 308 of the telescopic shaft 302, whereby the rotating gear 342 transfers rotation of the rotating bar 336 to the base gear 308 and thereby rotates the telescopic shaft 302.

The shaft 302 may extend and retract by the elevating motor 330. For example, as may be seen in FIG. 4, the telescopic shaft 302 may include a key 304 positioned above, e.g., on top of, a coupler 306 along the vertical direction V. In some embodiments, e.g., as illustrated in FIG. 4, the key 304 may include a pocket 312 and the coupler 306 may include a tab 314 which is configured, e.g., sized and shaped, to be received within the pocket 312. Similarly, the base gear 308 may include a tab 318 which is configured, e.g., sized and shaped, to be received within a pocket 316 of the coupler 306. In particular embodiments, each tab 314, 318 may be received within the respective pocket 312, 316 such that the tab 314, 318 is slidable within the pocket 312, 316, e.g., generally along the vertical direction V. For example, each tab 314, 318 may be unconstrained along the vertical direction V when the tab 314, 318 is received within the respective pocket 312, 316. The coupler 306 may also include a flange 310. The oven appliance 100 may further include an elevating bar 320 which extends generally perpendicular to the vertical direction V from a first end 322 to a second end 326, e.g., along a longitudinal axis of the elevating bar 320. The second end 326 of the elevating bar 320 may be coupled to the elevating motor 330 such that the elevating motor 330 rotates the elevating bar 320, e.g., about the longitudinal axis thereof, when the elevating motor 330 is activated. For example, the elevating motor 330 may be operable to rotate the elevating bar 320 by about ninety degrees in either direction, e.g., either clockwise or counterclockwise. An elevating cam 324 may be positioned at the second end 322 of the elevating bar 320. The elevating cam 324 may be positioned below and proximate to, e.g., in contact with, the flange 310 of the coupler 306, such that rotation of the elevating bar 320 and the elevating cam 324 thereon may be transferred to the shaft 302 via the flange 310, whereby the shaft 302 moves between the disengaged position (shown in FIG. 4) and the engaged position when the elevating bar 320 rotates by about ninety degrees. In some embodiments, the elevating cam 324 may be asymmetrical, e.g., the elevating cam 324 may include a major axis which is longer than a minor axis of the elevating cam 324. In such embodiments, the major axis of the elevating cam 324 may be oriented generally perpendicular to the vertical direction V when the shaft 302 is in the disengaged position and may be oriented generally along or parallel to the vertical direction V when the shaft 302 is in the engaged position. Thus, rotation of the elevating cam 324 by about ninety degrees from the disengaged position, e.g., whereby the major axis of the elevating cam 324 is oriented generally along the vertical direction V, may extend the telescopic shaft 302 to the engaged position. For example, the elevating cam 324 may bear on the flange 310 of the coupler 306 of the shaft 302, thereby pushing the coupler 306 and key 304 upwards along the vertical direction V to the engaged position when the cam 324 rotates so that the major axis of the cam 324 is vertically oriented or approaches a vertical orientation.

In some embodiments, the elevating bar 320 may also include a switch cam 328 thereon. A position switch 332 may be positioned proximate to the switch cam 328, whereby rotation of the elevating bar 320 between the engaged position and the disengaged position may cause the switch cam 328 to activate or deactivate the position switch 332. The position switch 332 may be operatively coupled to the controller 140, whereby the controller 140 may distinguish the positions of the telescopic shaft 302 in response to a signal from the switch 332, e.g., when the elevating bar 320 rotates and causes the switch cam 328 to actuate the switch 332, where the switch 332 is actuated by the switch cam 328 when the shaft 302 is in one of the engaged position and the disengaged position.

Figure 5:
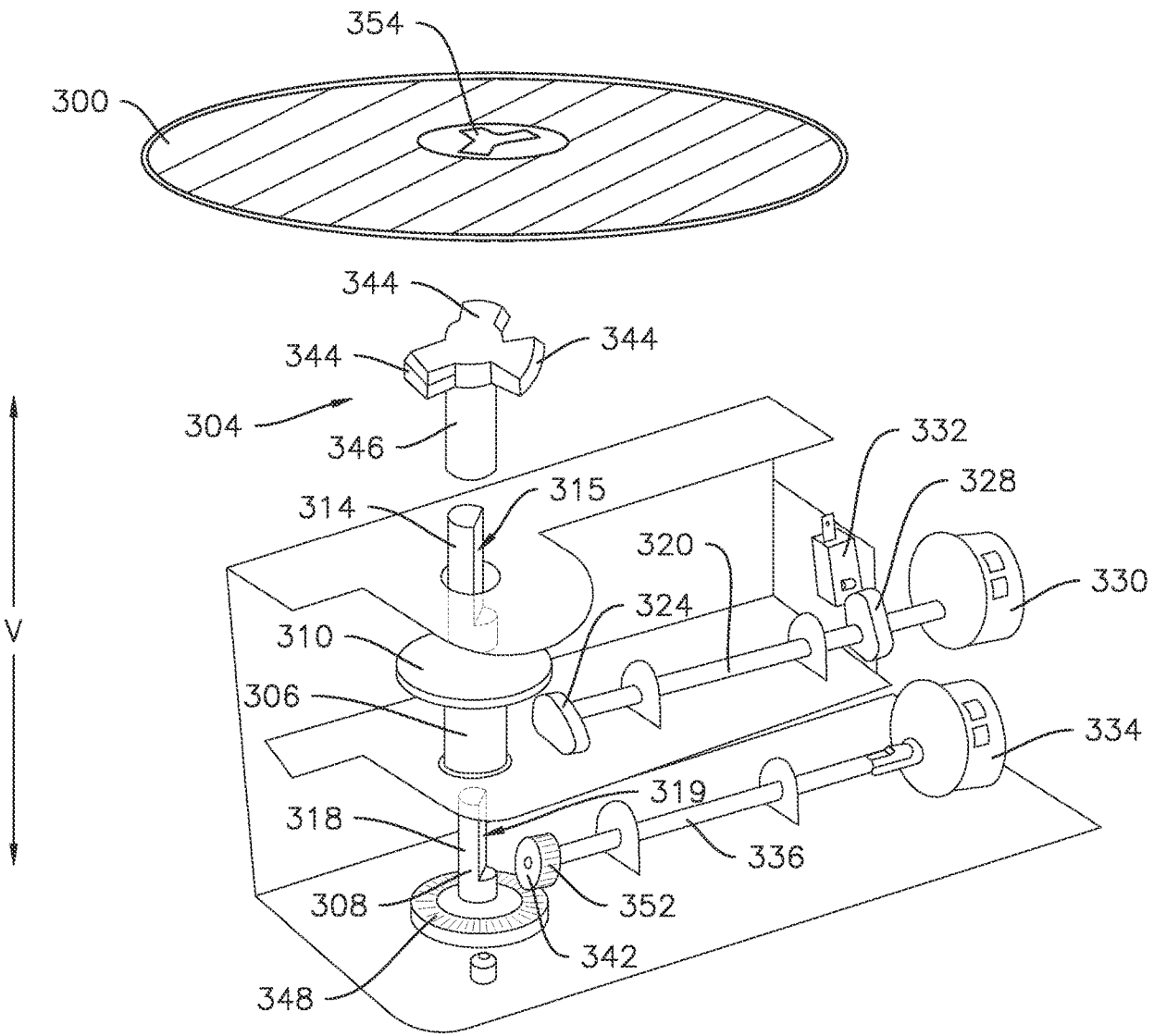
FIG. 5 provides a partially exploded perspective view of a turntable system according to one or more embodiments of the present subject matter which may be incorporated into an oven appliance such as the oven appliance of FIG. 1.

FIG. 5 provides a perspective view of the shaft 302 and neighboring components with the shaft 302 exploded. As described above, the key 304 may be slidably connected to the coupler 306 and the coupler 306 may be slidably connected to the base gear 308 to permit relative movement among the components of the shaft 302 along the vertical direction V, e.g., at least between the coupler 306 and the base gear 308, such as when the telescopic shaft 302 extends and retracts. Also, the components of the telescopic shaft 302 may be interconnected such that the components are not rotatable relative to one another, e.g., in order to transfer rotation from one component of the shaft 302 to another abutting portion of the shaft 302. More specifically, the tab 318 of the base gear 308 may include a flat 319 thereon and the pocket 316 of the coupler 306 may include a mating flat surface in order to prevent or limit relative rotation between the base gear 308 and the coupler 306, e.g., whereby rotation of the base gear 308 by the rotating gear 342 may be transferred to the coupler 306. Similarly, the tab 314 of the coupler 306 may include a flat 315, and the pocket 312 of the key 304 include a mating flat surface in order to prevent or limit relative rotation between the coupler 306 and the key 304 when the tab 314 of the coupler 306 is received within the pocket 312 of the key 304. As a result of such mating engagement of the flat surfaces, rotation of the coupler 306 may be transferred to the key 304 and, when the shaft 302 is in the engaged position, from the key 304 to the turntable 300.

Also as may be seen in FIG. 5, the rotating gear 342 may include teeth 352 thereon and the base gear 308 may include mating teeth 348 thereon. The teeth 352 of the rotating gear 342 may be engaged with the teeth 348 of the base gear. Thus, the rotation of the rotating bar 336 and the rotating gear 342 thereon may be transferred to the telescopic shaft 302 through such mutual engagement of the teeth 348 and 352 of the gears 308 and 342.

Figure 6:
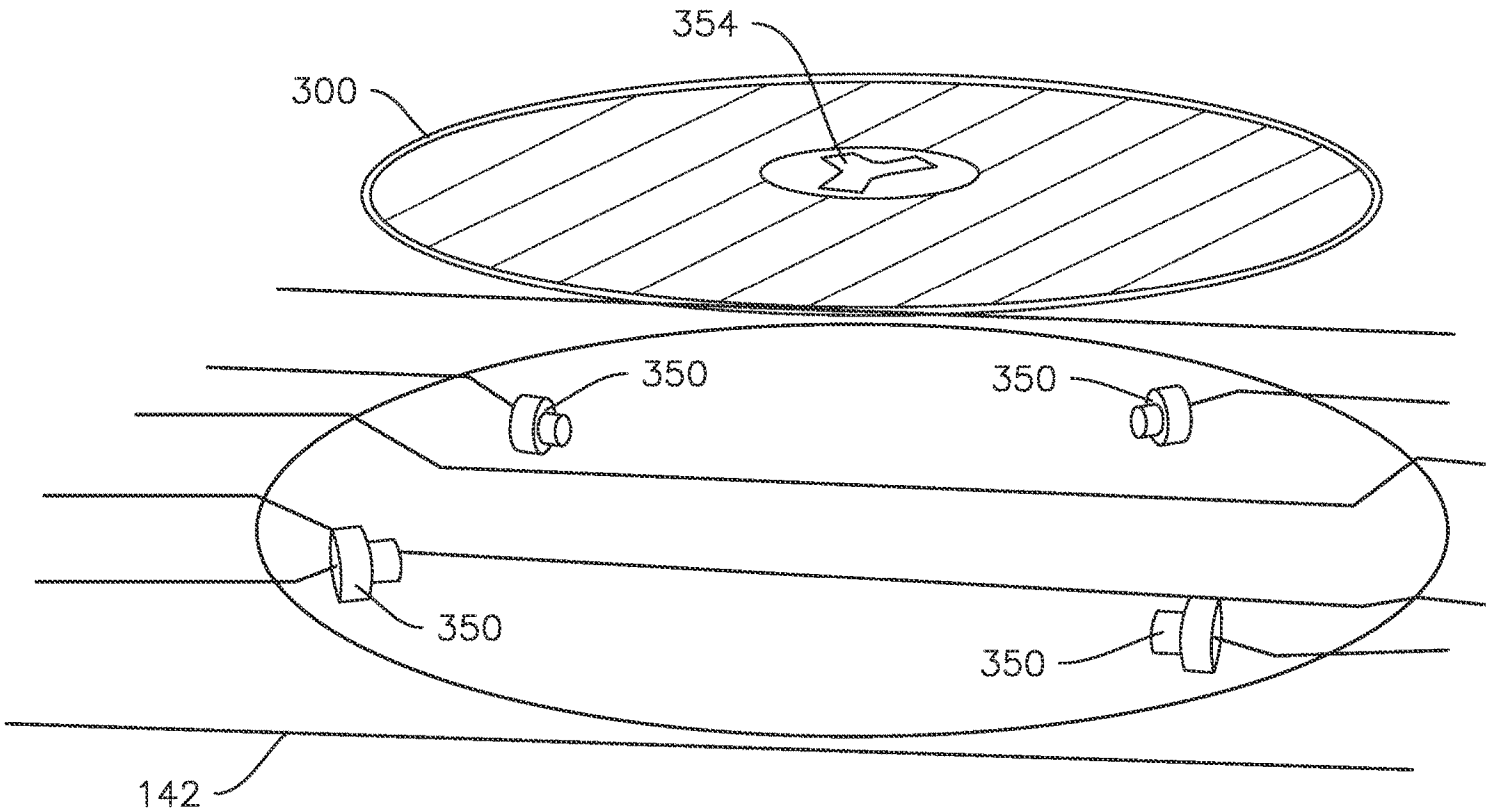
FIG. 6 provides a perspective view of a turntable and a rack according to one or more embodiments of the present subject matter which may be incorporated into an oven appliance such as the oven appliance of FIG. 1.
Figure 7:
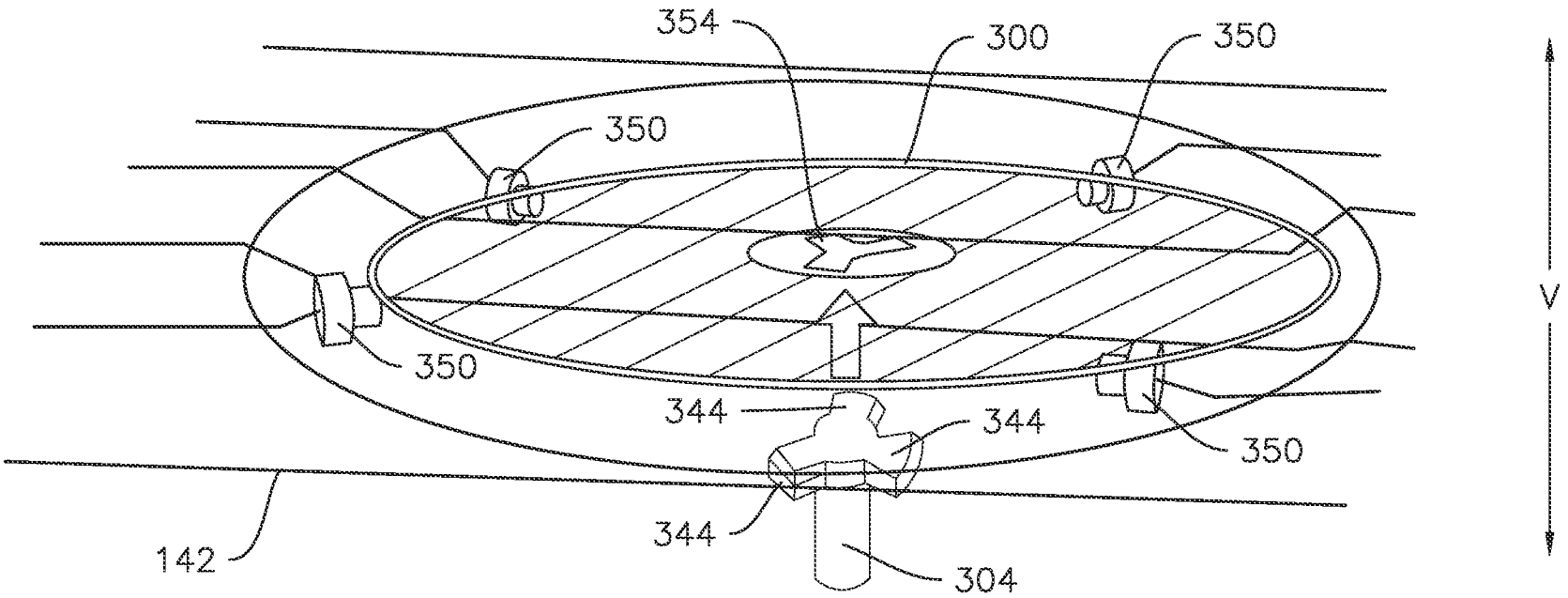
FIG. 7 provides a perspective view of a turntable, a rack, and a key of a shaft, with the key of the shaft in a disengaged position, according to one or more embodiments of the present subject matter which may be incorporated into an oven appliance such as the oven appliance of FIG. 1.

As may be seen in FIGS. 5 through 7, the key 304 may include a cylindrical main body 346, e.g., within which the pocket 312 (FIG. 4) is formed, and one or more radial arms 344 which extend radially outward from the cylindrical main body 346. For example, in some embodiments, the key 304 may include three arms 344, e.g., as illustrated in FIGS. 5 through 7. The turntable 300 may include a slot 354 which receives the key 304 of the shaft 302, whereby the shaft 302 turns the turntable 300, as described, e.g., when the rotating gear 342 rotates the shaft 302 at the base gear 308 thereof. For example, in embodiments such as the illustrated example embodiments of FIGS. 5 through 7 where the key 304 includes three arms 344, the slot 354 may be sized and shaped to correspond to and receive the arms 344 of the key 304 therein. In some embodiments, the slot 354 may therefore be Y-shaped, such as the slot 354 may include three branches that are equally spaced, e.g., about 120° apart, around the cylindrical main body 346 of the key, and that are approximately equal in length. Additionally, the arms 344 of the key 304 may be chamfered (see, e.g., FIGS. 5 and 7), such as at or along a top portion of the or each arm 344, in order to facilitate receipt of the key 304 within the slot 354.

As may be seen in FIGS. 6 and 7, the turntable 300 may, in some embodiments, be rotatably mounted on the rack 142 by a plurality of rollers or wheels 350. In some embodiments, the wheels 350 may be directly connected to the rack 142, e.g., elongate members of the rack 142 may provide the axle for each respective wheel 350 about which the wheel 350 rotates, for example as in the embodiments illustrated in FIGS. 6 and 7. In additional embodiments, some or all of the wheels 350 may also or instead be directly mounted on the turntable 300, where elongate members of the turntable 300 provide the axle about which each wheel 350 mounted thereon rotates.

Figure 8:
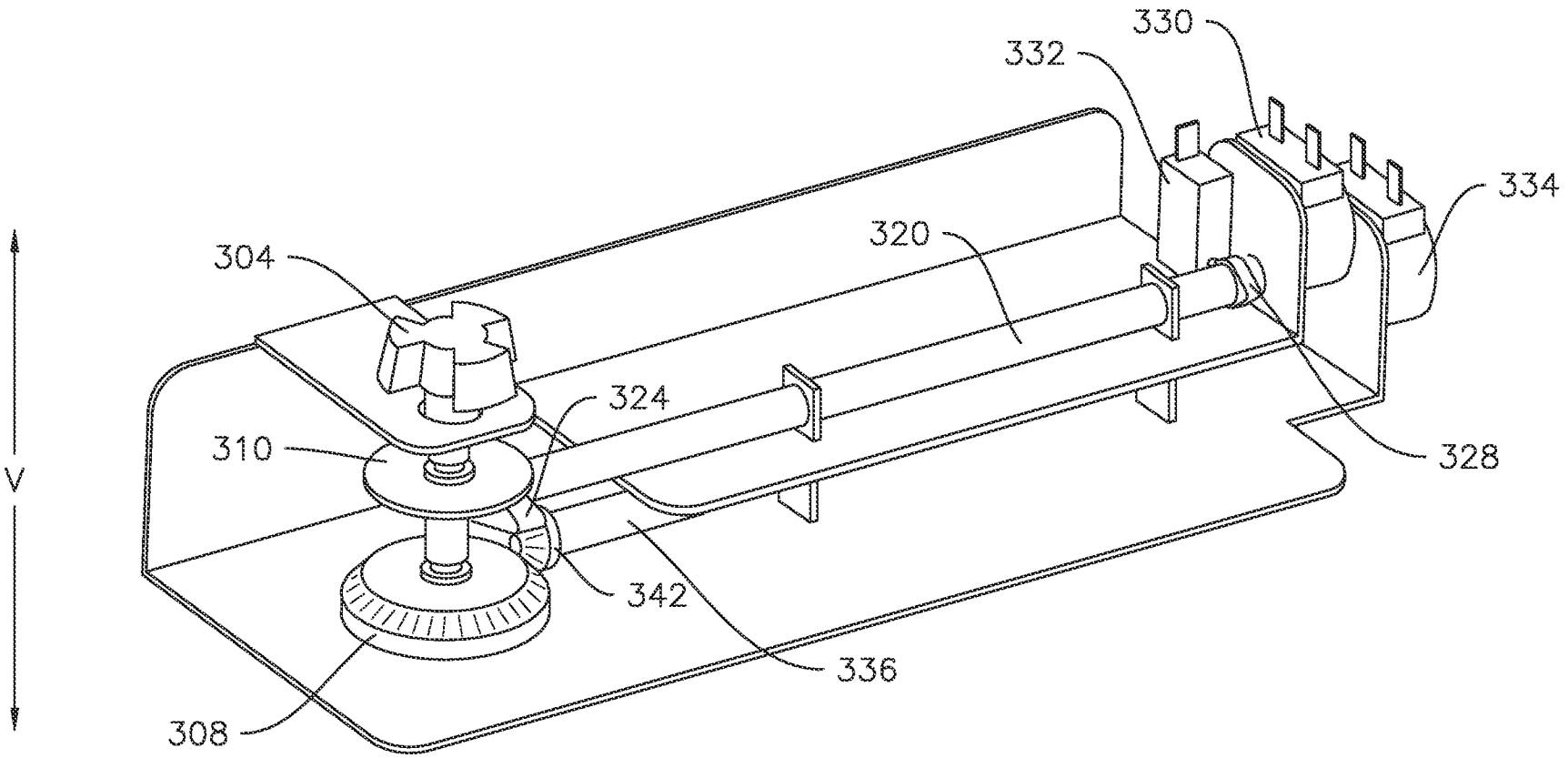
FIG. 8 provides a perspective view of components of a turntable system according to one or more embodiments of the present subject matter which may be incorporated into an oven appliance such as the oven appliance of FIG. 1.
Figure 9:
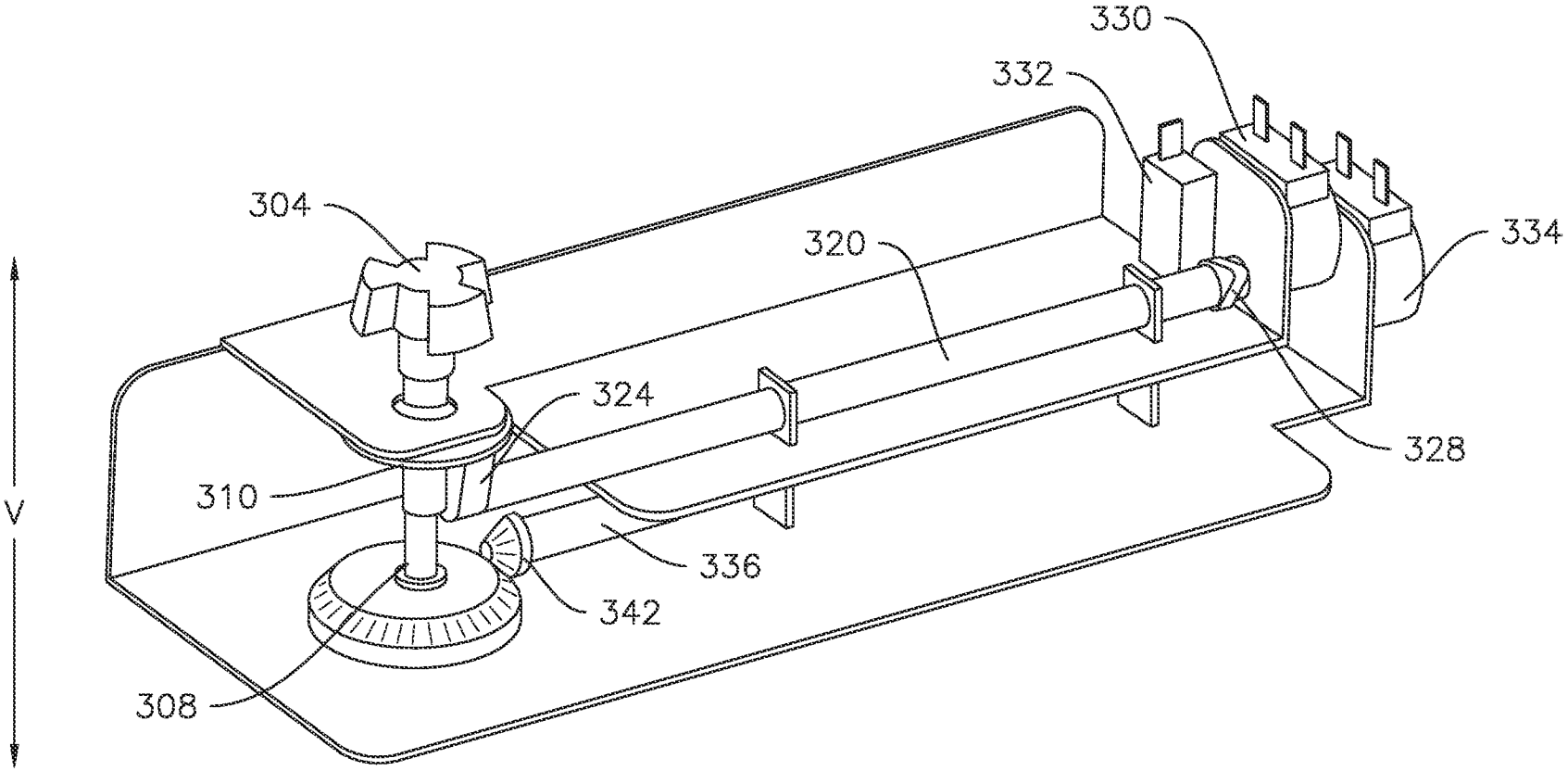
FIG. 9 provides a perspective view of the components of FIG. 8 with a telescopic shaft thereof in an engaged position.
Figure 10:
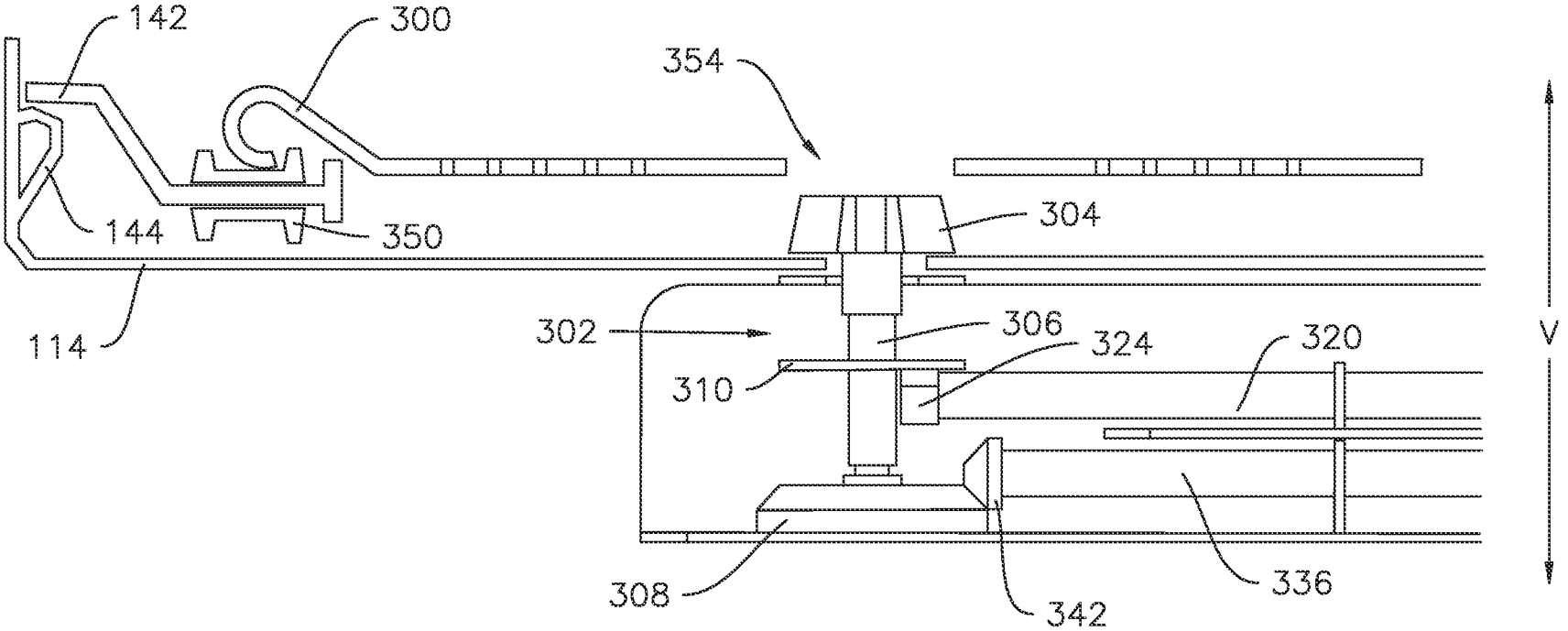
FIG. 10 provides a partial, schematic section view of components of a turntable system according to one or more embodiments of the present subject matter with the telescopic shaft thereof in a disengaged position.
Figure 11:
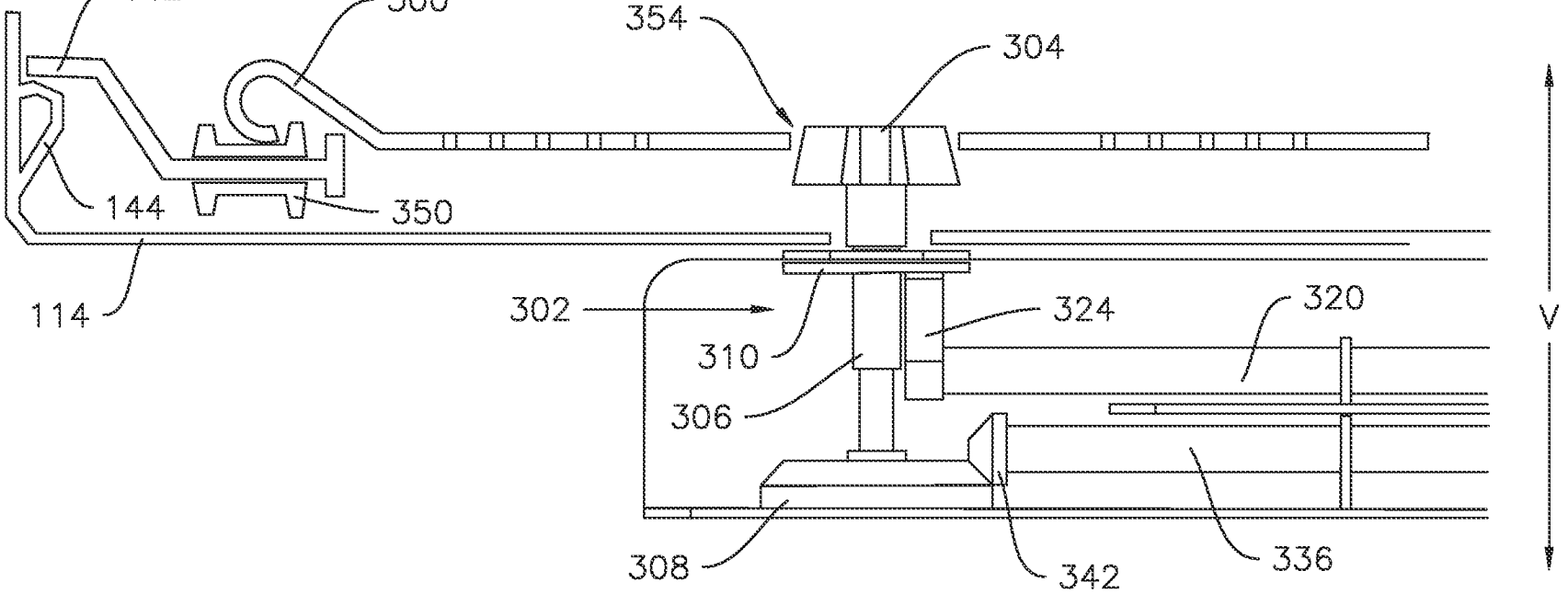
FIG. 11 provides a partial, schematic view of the components of FIG. 10 with the telescopic shaft in an engaged position.
Figure 12:
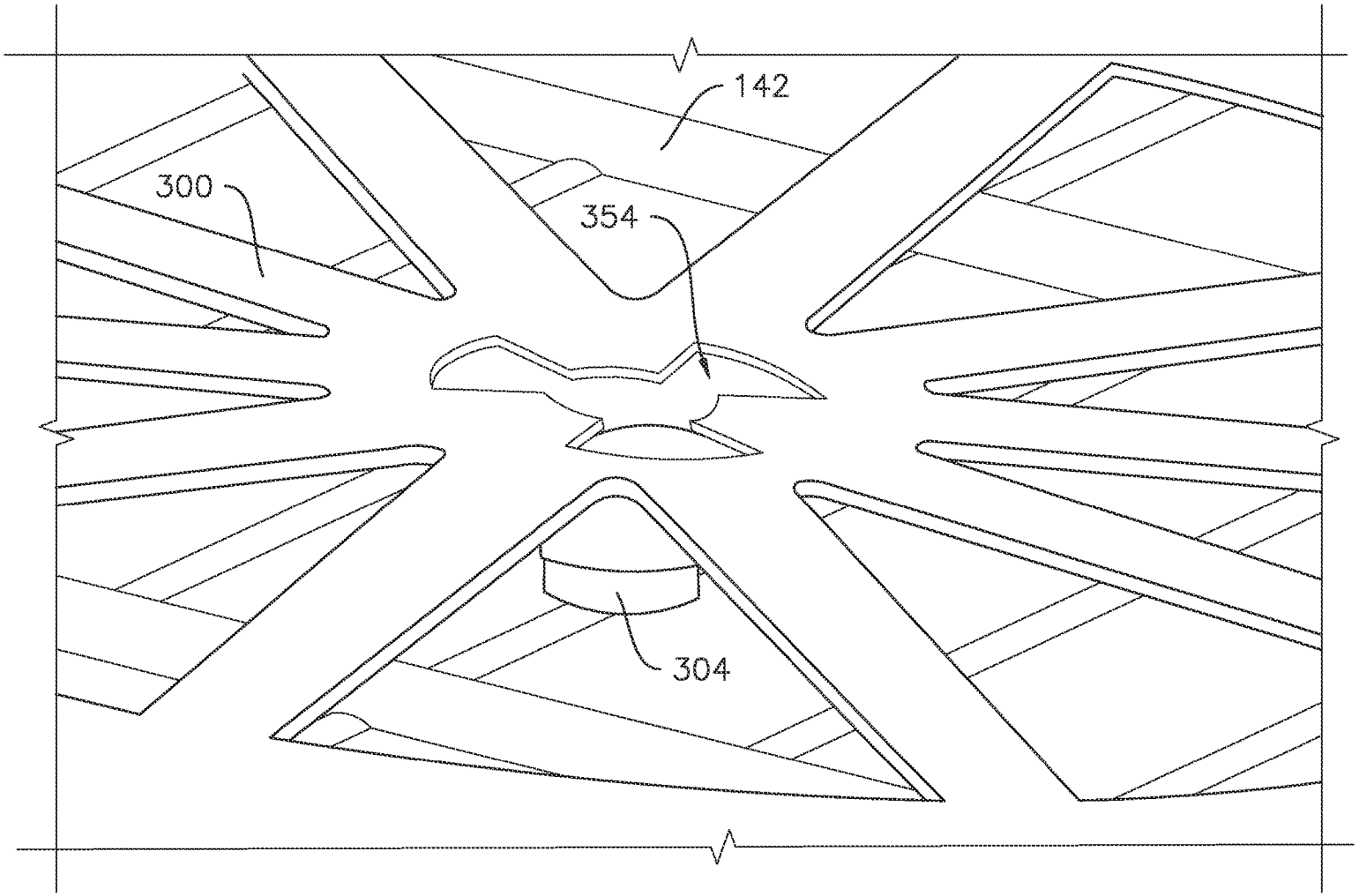
FIG. 12 provides a close-up perspective view of a slot of a turntable and a key of a telescopic shaft according to one or more embodiments of the present subject matter with the key in a disengaged position.
Figure 13:
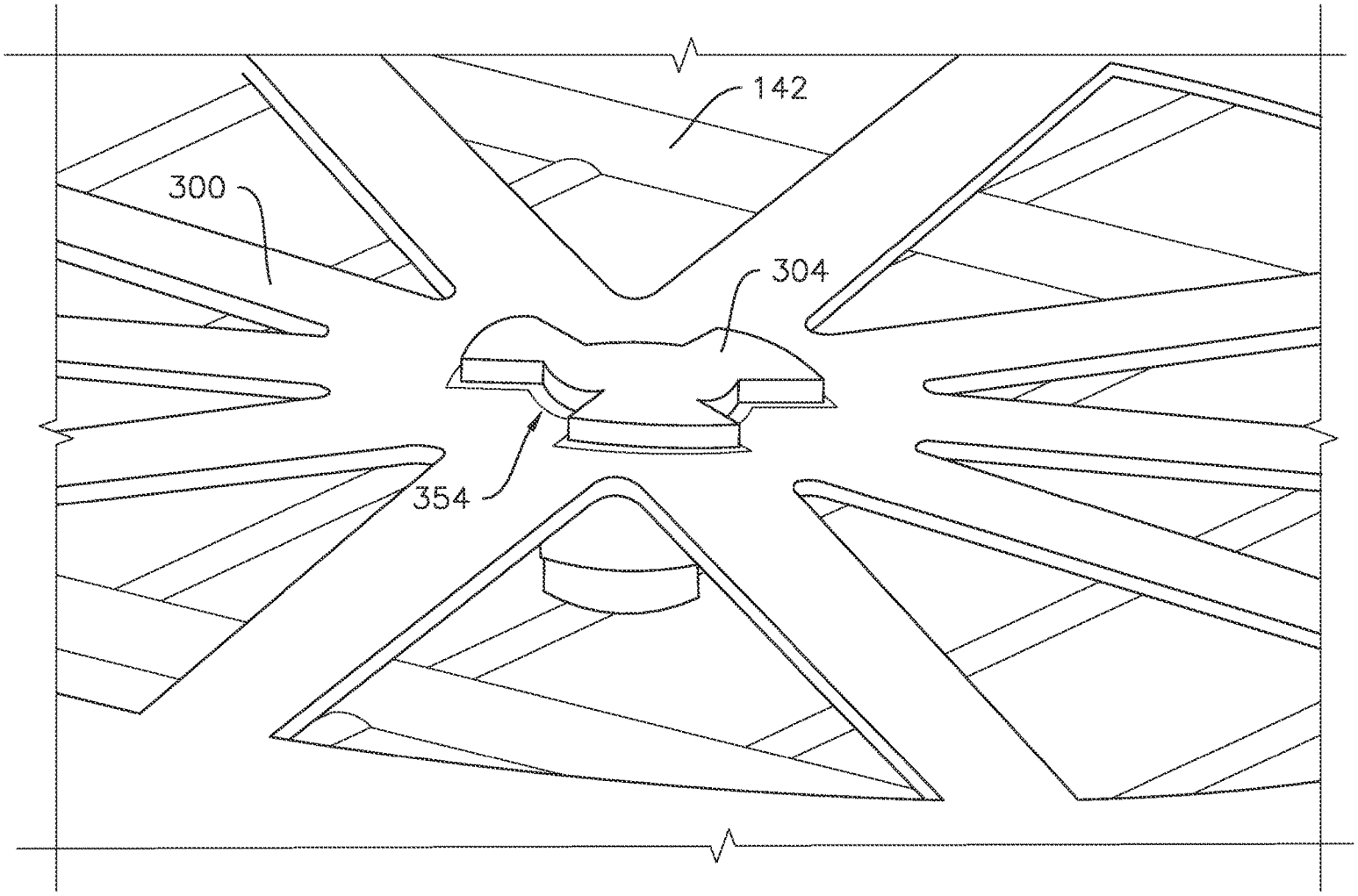
FIG. 13 provides a close-up perspective view of the slot and the key of FIG. 12 with the key in an engaged position.

FIGS. 8, 10, and 12 illustrate various views of the turntable system with the shaft 302 in the disengaged position. FIGS. 9, 11, and 13 provide corresponding views of the turntable system with the shaft 302 in the engaged position. As may be seen, for example, in FIGS. 8 and 9, the elevating cam 324 is oriented with the major axis thereof generally perpendicular to the vertical direction V when in the disengaged position (FIG. 8) and with the major axis thereof generally along or parallel to vertical direction V when in the engaged position (FIG. 9), such that the elevating cam 324 lifts the flange 310 of the coupler 306 upward, towards the turntable 300, along the vertical direction V, causing the telescopic shaft 302 to extend to the engaged position. As described above, the coupler 306 is slidable relative to the base gear 308 along the vertical direction V and the key 304 is slidable relative to the coupler 306 along the vertical direction V. Thus, as may be seen in FIGS. 10 and 11, the telescopic shaft 302 may extend (as shown in FIG. 11) and retract (as shown in FIG. 10) due to the base gear 306, coupler 306, and key 304 varying in their relative positions and the extent to which they overlap along the vertical direction V. As may be seen, for example, in FIGS. 10 through 13, the key 304 may be positioned below, such as directly below, the slot 354 along the vertical direction when the shaft 302 is in the disengaged position, and the key 304 may travel upwards, such as along a straight vertical linear path, as the telescopic shaft 302 extends to the engaged position, whereupon the key 304 fits within the slot 354 in order to permit the turntable 300 to rotate with the shaft 302 when the shaft 302 is turned, e.g., by the rotating gear 342 turning the base gear 308. As may be seen in particular in FIG. 13, the key 304 corresponds in shape to the slot 354 and may, in at least some embodiments, be sized for a snug fit within the slot 354 to provide a secure connection between the shaft 302 and the turntable 300.

In at least some embodiments, the oven appliance 100 is not a microwave oven. For example, the oven appliance 100 may not include any microwave heating features or may include additional heating elements in addition to microwave heating, e.g., the oven appliance 100 may not exclusively provide microwave heating. In particular embodiments, the oven appliance 100 includes at least one bottom heating element 126 at or proximate to (e.g., spaced apart from by ten percent of a vertical height of the cooking chamber or less) the bottom wall 114, such that the turntable 300 is advantageously spaced apart from the bottom wall 114 on the rack 142 in order to avoid or reduce overheating of the turntable 300 and/or food items thereon, such as in order to avoid direct conductive heating of the turntable 300 from the bottom heating element 126 and/or from the bottom wall 114.

The turntable 300 may be particularly useful for heating frozen items. In at least some embodiments, the ability to extend or retract the shaft 302 and thereby selectively rotate the turntable 300 during some cooking operations or have the turntable 300 remain stationary, e.g., not turn or rotate by the rotating motor 334 and/or shaft 302, during other cooking operations may advantageously provide increased flexibility to the oven appliance 100 for cooking or heating items of various sizes and various starting temperatures while ensuring even and consistent heating of such items. Additionally, the turntable 300 and the accompanying components which provide selective rotation thereof, e.g., the shaft 302, bars 320 and 336, and motors 330 and 334, may advantageously be relatively simple in construction and operation in that the turntable 300 only moves relative to the rack 142 by rotating, e.g., the turntable 300 itself does not move up or down along the vertical direction V during operation. As may be seen in FIGS. 5 and 6, the turntable 300 may be removable from the rack 142, e.g., for cleaning, however, such movement of the turntable 300 relative to the rack 142 (e.g., removal of the turntable 300 from the rack 142) is manually performed and does not require any additional components or structures of the oven appliance 100 to provide such movement. Thus, in at least some embodiments, only the shaft 302 moves along the vertical direction V and not the rack 142 or turntable 300, which allows the system to be relatively simple in construction, as noted.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. An oven appliance, comprising:

a cabinet defining a vertical direction, a lateral direction, and a transverse direction, the vertical, lateral, and transverse directions being mutually perpendicular, the cabinet comprising a front portion spaced apart from a back portion along the transverse direction and a left side spaced apart from a right side along the lateral direction;

a chamber defined within the cabinet for receipt of food items for cooking, the chamber delineated by a plurality of walls including a bottom wall, a left side wall, and a right side wall;

a rack slidably received within the chamber and above the bottom wall of the chamber along the vertical direction;

a turntable rotatably mounted on the rack;

a telescopic shaft positioned and configured to extend and retract along the vertical direction between an engaged position wherein the shaft engages the turntable to rotate the turntable and a disengaged position wherein the shaft is spaced apart from the turntable along the vertical direction, the telescopic shaft comprising a coupler and a key configured to engage a slot in the turntable when the shaft is in the engaged position; and an elevating bar, the elevating bar extending from a first end coupled to an elevating motor to a second end, the elevating bar comprising an elevating cam disposed at the second end of the elevating bar, wherein the elevating cam is configured to move the coupler between the engaged position and the disengaged position, the elevating bar defining a longitudinal axis, wherein the elevating motor is operable to rotate the elevating bar about the longitudinal axis between the engaged position and the disengaged position.

2. The oven appliance of claim 1, wherein the telescopic shaft further comprises a base gear.

3. The oven appliance of claim 2, further comprising a rotating bar, the rotating bar extending from a first end coupled to a rotating motor to a second end, the rotating bar comprising a rotating gear disposed at the second end of the rotating bar, the rotating gear engaged with the base gear of the telescopic shaft, whereby the rotating gear transfers rotation of the rotating bar to the base gear, thereby rotating the telescopic shaft.

4. The oven appliance of claim 1, wherein the elevating motor is operable to rotate the elevating bar about the longitudinal axis by about ninety degrees from the engaged position to the disengaged position and from the disengaged position to the engaged position.

5. The oven appliance of claim 1, further comprising a location switch positioned proximate to the elevating bar and a switch cam on the elevating bar positioned proximate the location switch, whereby the switch cam actuates the location switch in one of the engaged position and the disengaged position.

6. The oven appliance of claim 1, wherein the turntable is rotatably mounted on the rack by a plurality of wheels.

7. An oven appliance, comprising:

a cabinet defining a vertical direction;

a chamber defined within the cabinet for receipt of food items for cooking;

a rack slidably received within the chamber above a bottom wall of the chamber along the vertical direction;

a turntable rotatably mounted on the rack;

a telescopic shaft positioned and configured to extend and retract along the vertical direction between an engaged position wherein the shaft engages the turntable to rotate the turntable and a disengaged position wherein the shaft is spaced apart from the turntable along the vertical direction, the telescopic shaft comprising a coupler and a key configured to engage a slot in the turntable when the shaft is in the engaged position;

an elevating bar, the elevating bar extending from a first end coupled to an elevating motor to a second end, the elevating bar comprising an elevating cam disposed at the second end of the elevating bar, wherein the elevating cam is configured to move the coupler between the engaged position and the disengaged position; and a location switch positioned proximate to the elevating bar and a switch cam on the elevating bar positioned proximate the location switch, whereby the switch cam actuates the location switch in one of the engaged position and the disengaged position.

8. The oven appliance of claim 7, wherein the telescopic shaft further comprises a base gear.

9. The oven appliance of claim 8, further comprising a rotating bar, the rotating bar extending from a first end coupled to a rotating motor to a second end, the rotating bar comprising a rotating gear disposed at the second end of the rotating bar, the rotating gear engaged with the base gear of the telescopic shaft, whereby the rotating gear transfers rotation of the rotating bar to the base gear, thereby rotating the telescopic shaft.

10. The oven appliance of claim 7, wherein the elevating bar defines a longitudinal axis, wherein the elevating motor is operable to rotate the elevating bar about the longitudinal axis between the engaged position and the disengaged position.

11. The oven appliance of claim 10, wherein the elevating motor is operable to rotate the elevating bar about the longitudinal axis by about ninety degrees from the engaged position to the disengaged position and from the disengaged position to the engaged position.

12. The oven appliance of claim 7, wherein the turntable is rotatably mounted on the rack by a plurality of wheels.

* * * * *